United States Patent [19]

Sugihara et al.

[11] 3,973,535

[45] Aug. 10, 1976

[54] EXHAUST GAS RECIRCULATION SYSTEM

[75] Inventors: Kunihiko Sugihara, Yokohama; Yasuo Nakajima, Yokosuka; Yoshimasa Hayashi; Shin-ichi Nagumo, both of Yokohama, all of Japan

[73] Assignee: Nissan Motor Co., Ltd., Yokohama, Japan

[22] Filed: May 20, 1975

[21] Appl. No.: 579,253

[30] Foreign Application Priority Data

June 27, 1974 Japan ..... 49-73731

[52] U.S. Cl. ..... 123/119 A

[51] Int. Cl.[2] ..... F02M 25/00

[58] Field of Search ..... 123/119 A

[56] References Cited

UNITED STATES PATENTS

| | | | |
|---|---|---|---|
| 3,835,827 | 9/1974 | Wolgenuth | 123/119 A |
| 3,884,200 | 5/1975 | Caldwell | 123/119 A |
| 3,896,777 | 7/1975 | Masahi | 123/119 A |

*Primary Examiner*—Charles J. Myhre
*Assistant Examiner*—R. H. Lazarus

[57] ABSTRACT

A valve responsive to both venturi vacuum and intake manifold vacuum operates a recirculation valve by means of vacuum amplification.

3 Claims, 6 Drawing Figures

10
12
14
16
16a
16b
18
20
20a
22
24
26
28
30
32
32a
32b
34
36
36a
36b
38
40
42
44
44a
46
46a
48
50
A

EXHAUST GAS RECIRCULATION SYSTEM

This invention relates generally to an exhaust gas recirculation system for an exhaust system of a motor vehicle and, more particularly, to an improved exhaust gas recirculation system.

It is well known in the art for the amount of exhaust gas recirculation to be varied in proportion to the amount of air supplied into an engine. A conventional exhaust gas recirculation system includes an exhaust gas recirculation passageway, in which a control valve is disposed for regulating the amount of exhaust gas recirculation proportionally to the vacuum prevailing at the venturi portion of the engine carburetor, the values of which vary proportionally to the amount of inducted air. A drawback is encountered with this prior art system in that, since the exhaust gas is recirculated into the engine cylinder in an amount approximately proportional to the amount of inducted air, the amount of exhaust gas recirculation is fixed at a constant value when the amount of inducted air is held at constant level and, thus, the amount of nitrogen oxides contained in the engine exhaust gases can not be controlled to a proper level for reducing atmospheric air pollution to an acceptable concentration.

It is, therefore, an object of the present invention to provide an improved exhaust gas recirculation system arranged to reduce the concentration of nitrogen oxides contained in engine exhaust gases.

It is another object of the present invention to provide an improved exhaust gas recirculation system which is simple in construction and easy to manufacture.

It is another object of the present invention to provide an improved exhaust gas recirculation system which is arranged to control the amount of exhaust gas recirculation with respect to the intake manifold vacuum of the engine of a motor vehicle.

It is a further object of the present invention to provide an improved exhaust gas recirculation system for an engine of a motor vehicle in which the amount of exhaust gas recirculation is increased with the decrease in the level of intake manifold vacuum of the engine and decreased with the increase in the level of the engine intake manifold vacuum.

It is a still further object of the present invention to provide an improved exhaust gas recirculation system by which the amount of nitrogen oxide is reduced to a satisfactory level as to air pollution.

These and other objects, features and advantages of the present invention will become more apparent from the following description when taken in conjunction with the accompanying drawings, in which.

Figures 1, 1A:
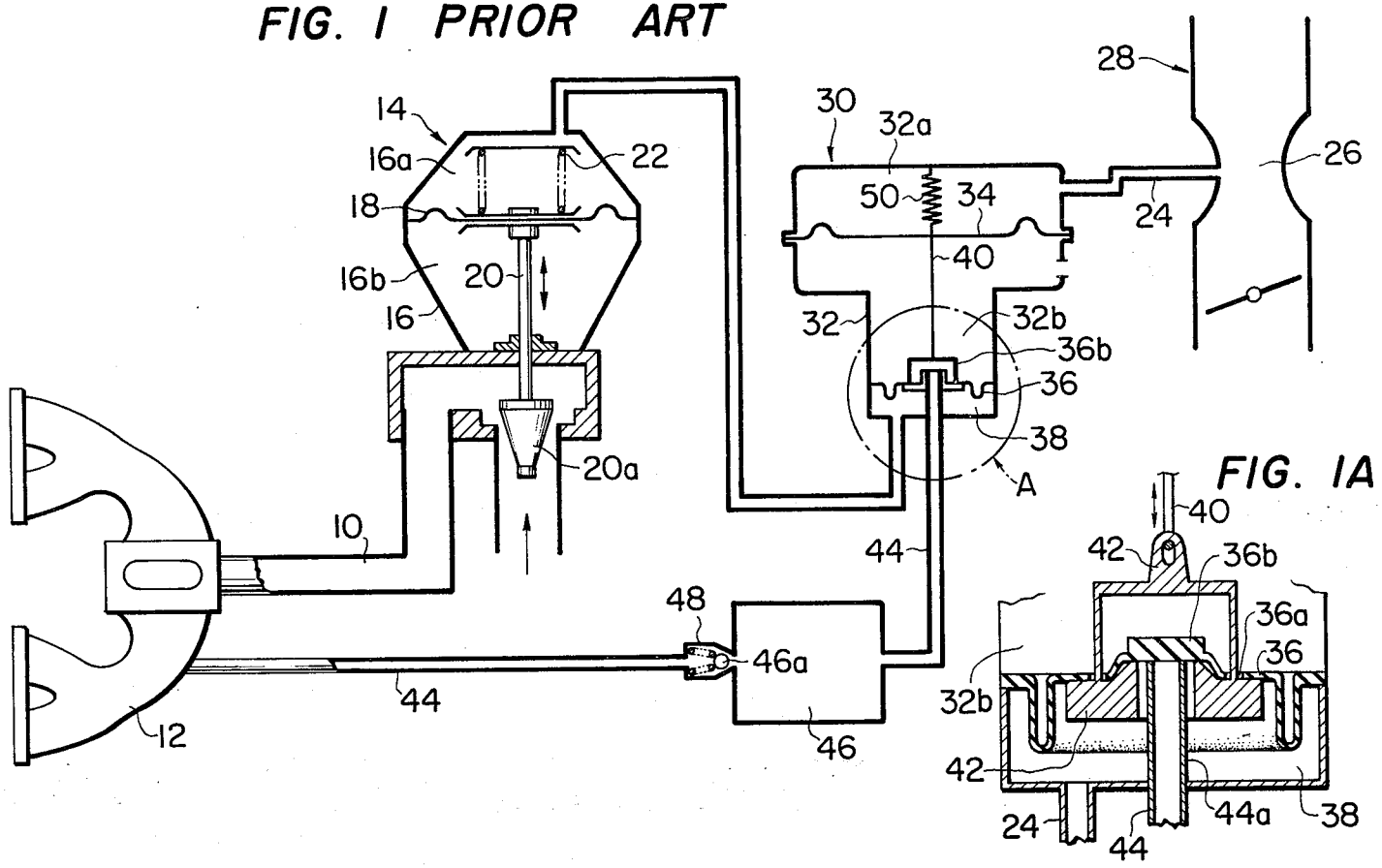
FIG. 1 PRIOR ART
FIG. 1 is a schematic view of a prior art exhaust gas recirculation system.
FIG. 1A is an enlarged section view illustrating a part of the system shown in FIG. 1.

Referring now to FIG. 1, there is schematically shown an example of a prior art exhaust gas recirculation system for a motor vehicle. As shown, the exhaust gas recirculation system includes an exhaust gas recirculation passageway 10 which connects the intake manifold 12 of the vehicle engine (not shown) and an exhaust manifold (not shown) of the engine for recirculating exhaust gases emitted from the exhaust manifold into the intake manifold 12. A control valve 14 is operatively disposed in the exhaust gas recirculation passageway 10 to control the amount of the exhaust gas recirculation. The control valve 14 is controlled by a diaphragm unit 16, in which a diaphragm member 18 is disposed. A valve stem 20 having a tapered valve head **20*a* is connected to and movable with the diaphragm member 18 in a direction to control the amount of the exhaust gas recirculation passing through the passageway 10. The diaphragm member 18 is normally biased by a compression spring 22 so that the valve head 20*a* is urged toward a position to decrease the amount of the exhaust gas recirculation through the passageway 10. As shown, the vacuum chamber 16*a* of the diaphragm unit 16 is in communication through a vacuum conduit 24 with the venturi portion 26 of the engine carburetor 28. A vacuum level control unit 30 is located in the vacuum conduit 24 to amplify the vacuum supplied from the venturi portion 26 of the engine carburetor 28. The vacuum level control unit 30 includes a casing 32 in which a first diaphragm member 34 is disposed. The diaphragm member 34 divides the casing 32 into a vacuum chamber 32*a* and an atmospheric chamber 32*b*. A second diaphragm member 36 is also disposed in the casing 32 to define a control chamber 38. The second diaphragm member 36 is formed with a plurality of small bores 36*a*, through which the atmospheric chamber 32*b* and the control chamber 38 are communicable. The first diaphragm member 34 is connected through a connecting rod 40 to a valve head 42, which cooperates with the second diaphragm member 36. The vacuum chamber 32*a* communicates through the conduit 24 with the venturi portion 26 of the engine carburetor 28 so that the suction or the vacuum prevailing at the venturi portion 26 is admitted to the vacuum chamber 32*a*. The atmospheric chamber 32*b* is in communication with the atmosphere through an opening (no numeral). The control chamber 38 is in communication with the vacuum chamber 16*a* of the control valve 14 through the conduit 24** to permit the regulated vacuum to pass thereinto.

As shown, a vacuum supply conduit 44 is provided to introduce intake manifold vacuum into the control chamber 38 of the casing 32. The vacuum supply conduit 44 is connected at its one end to the intake manifold 12 of the engine. A vacuum tank 46 is located in the vacuum supply conduit 44. A check valve 48 is also located in the vacuum supply conduit 44 at an inlet portion **46*a* of the vacuum tank 46. The vacuum supply conduit 44 has a projecting end portion 44*a* which extends into the control chamber 38. As best shown in FIG. 1A, an engaging portion 36*b* of the second diaphragm member 36 is engageable with the projecting end portion 44*a* to prevent the intake manifold vacuum from being admitted to the control chamber 38. As shown in FIG. 1, the first diaphragm member 34 is normally biased by a tension spring 50** in a direction to move the valve head downward.

With the arrangement mentioned hereinabove, the vacuum prevailing at the venturi portion 26 of the engine carburetor 28 is introduced into the vacuum chamber 32*a* through the conduit 24 and acts on the first diaphragm member 34 to move the same upward, as viewed in FIG. 1, against the action of the tension spring 50. This causes the connecting rod and accordingly the valve element 42 to move upward so that the engaging portion of the second diaphragm member 36 is brought out of engagement with the projecting end portion 44*a* of the conduit 44 for thereby admitting the intake manifold vacuum into the control chamber 38. The intake manifold vacuum thus admitted to the control chamber 38 is then delivered to the vacuum chamber 16*a* of the control valve 14. The intake manifold vacuum then acts on the diaphragm member 18 to move the same upward as viewed in FIG. 1 against the action of the compression spring 22. Consequently, the valve head 20*a* connected to the diaphragm member 18 is moved upward so that the effective sectional area of the passageway 10 is increased and, thus, the amount of exhaust gas recirculation is increased. If, in this instance, the vacuum prevailing at the venturi portion 26 of the engine carburetor 28 decreases with the decrease in the amount of air passing therethrough, then the force developed by the vacuum acting on the first diaphragm member 34 is decreased. Under this circumstance, the first diaphragm member 34 is caused to move downward by the action of the tension spring 50 so that the valve element 42 connected to the second diaphragm member 34 is moved to a position to open the small bores 36*a* of the second diaphragm member 36. Therefore, the intake manifold vacuum existing in the control chamber 38 inducts air through the small bores 36*a* from the atmospheric chamber 32*b*, and the level of the intake manifold vacuum in the control chamber 38 is reduced.

It will thus be seen that the exhaust gases are recirculated through the passageway 10 into the intake manifold 12 in an amount proportional to the amount of air supplied into the engine. Thus, even though the valve opening is at constant degree and the amount of the air is at a constant level, the amount of exhaust gas recirculation varies in accordance with the variations in the intake manifold vacuum. The amount of exhaust gas recirculation increases with the increase in the intake manifold vacuum even when the amount of intake air and accordingly the venturi vacuum is at constant value, thereby deteriorating the performance efficiency of the engine operating under light loads. Since, for the above reason, the rate of exhaust gas recirculation should be so regulated as to prevent the deterioration of the operating performance efficiency of the engine under light loads, it is difficult to increase the rate of exhaust gas recirculation when the engine is operating under medium and heavy loads, and, thus, the amount of nitrogen oxides contained in the engine exhaust gases cannot be satisfactorily reduced.

The present invention contemplates to control the amount of exhaust gas recirculation in dependence on the variations in the intake manifold vacuum for satisfactorily reducing the amount of the nitrogen oxides contained in the engine exhaust gases.

Figure 2:
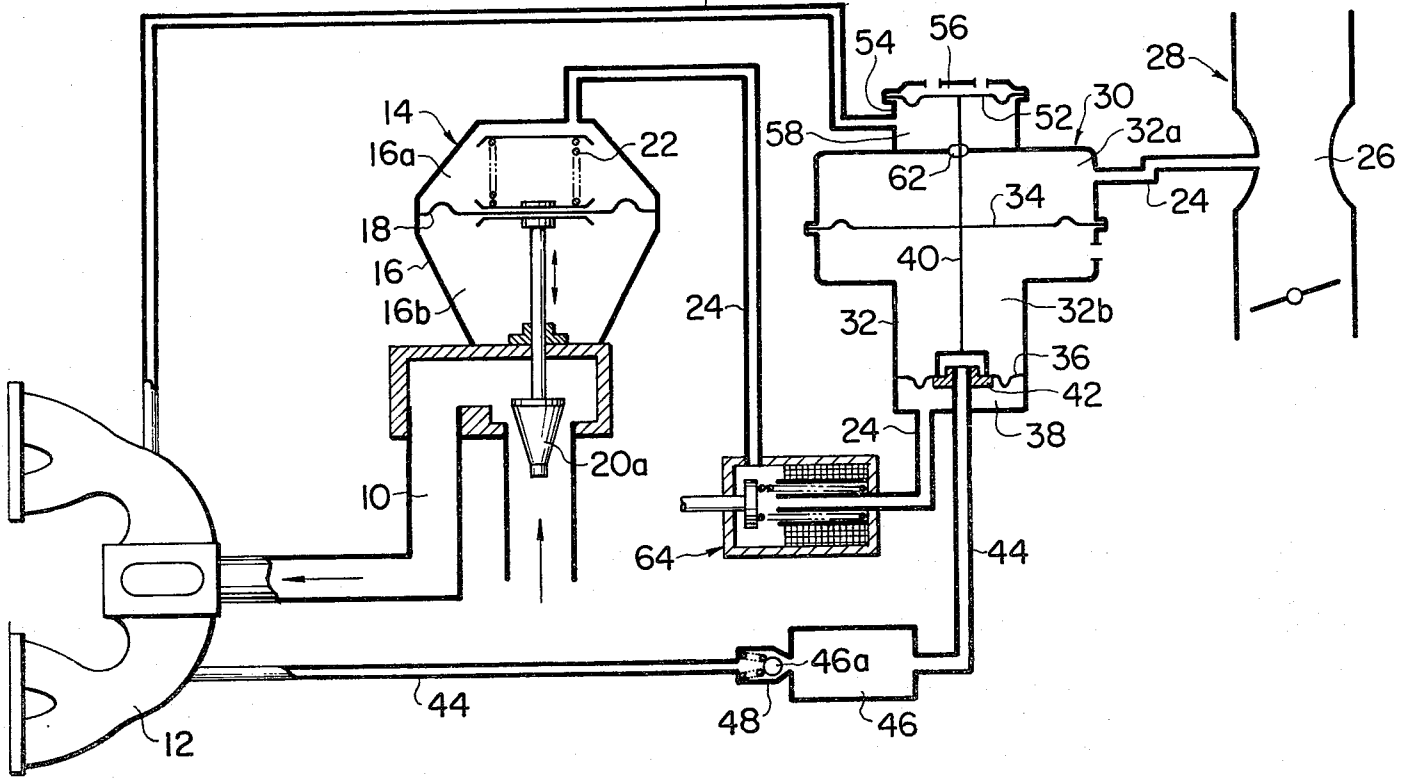
FIG. 2 is a schematic view of a preferred embodiment of an exhaust gas recirculation system according to the present invention.

An improved exhaust gas recirculation system to carry out the above concept is schematically shown in FIG. 2, in which like or corresponding component parts are designated by the same numerals as those used in FIGS. 1 and 1A. According to the present invention, the vacuum level control unit 30 further includes a third diaphragm member 52 responsive to the intake manifold vacuum. The third diaphragm member 52 is disposed in a casing 54 attached to the casing 32 and divides the casing 54 into an atmospheric chamber 56 and a vacuum chamber 58. The atmospheric chamber 56 is vented to the atmosphere through bores (no numeral), while the vacuum chamber 58 is in communication through a conduit 60 with the intake manifold 12 of the engine. The third diaphragm member 52 is connected to the connecting rod 40 to which the first diaphragm member 34 responsive to the suction in the venturi portion of the engine carburetor 28 is also connected. Indicated at 62 is a sealing member which provides sealing between the vacuum chamber 58 and the vacuum chamber 32*a*. It should be noted that the compression spring 50 is dispensed with in the exhaust gas recirculation system of the present invention.

Designated by reference numeral 64 is a three-way solenoid valve which is disposed in the conduit 24 between the vacuum chamber 16*a* of the control valve 14 and the control chamber 38 of the vacuum level control unit 30. The three-way solenoid valve 64 may be of any known construction insofar as it functions to shut off the conduit 24 to prevent the intake manifold vacuum from being supplied into the vacuum chamber 16*a* for causing the valve head 20*a* to close the passageway 10 during starting of the engine.

Assuming now that the intake manifold vacuum in the intake manifold 12 is at a constant level, when the venturi vacuum (Pv), viz., the vacuum in the vacuum chamber 32*a* of the vacuum level control unit 30 is at high level, the first diaphragm member 34 is moved upward as viewed in FIG. 2 and accordingly the valve element 42 is moved upward. In this instance, the engaging portion 36*b* of the second diaphragm member 36 disengages from the projecting end portion 44*a* of the conduit 44 so that the vacuum in the vacuum tank 46 is admitted to the control chamber 38 through the conduit 44 in a manner as shown in FIG. 2A. Since, at this instant, the vacuum in the control chamber 38 increases and, thus, the diaphragm member 18 of the control valve head 20*a* is moved upward against the action of the compression spring 22 to increase the effective cross sectional area of the exhaust gas recirculation passageway 10.

Figure 2B:
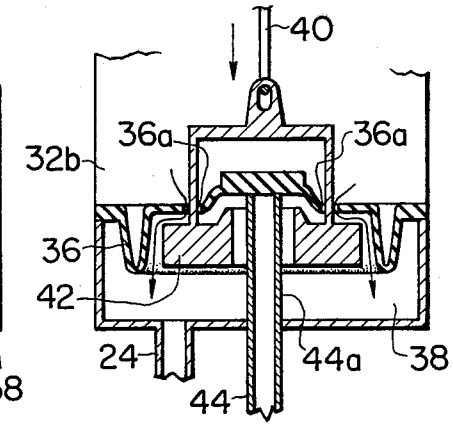
FIGS. 2A and 2B are enlarged section views showing the operation of a part of the system shown in FIG. 2.
Figure 2A:
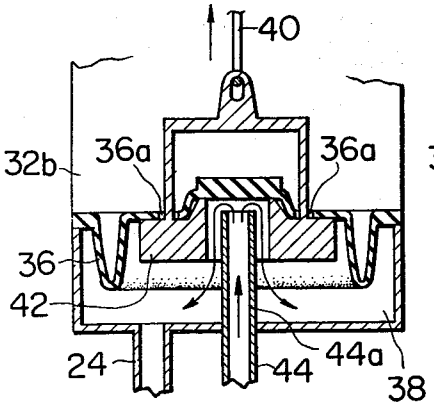

In contrast, when the vacuum in the vacuum chamber 32*a* is at a low level, the valve element 42 is moved downward as shown in FIG. 2B. In this instance, the engaging portion 36*b* of the second diaphragm member 36 is brought into engagement with the projecting end portion 44*a* of the conduit 44 while, at the same time, the plurality of bores 36*a* are opened to permit the flow of the atmospheric air into the control chamber 38 so that the vacuum in the control chamber 38 is reduced. Consequently, the vacuum in the vacuum chamber 16*a* of the control valve 14 is reduced and, thus, the valve head 20*a* is moved to a position to decrease the effective cross sectional area of the passageway 10.

Assuming now that the vacuum in the intake manifold 12 is at a constant level, the pressure in the control chamber 38 is expressed by the following equation:

$$Pe = \frac{S_1}{S_2} \cdot Pv \qquad (1)$$

where Pe is the pressure in the control chamber 38, Pv is the vacuum prevailing at the venturi portion 26 of the engine carburetor 28, $S_1$ is the effective sectional area of the first diaphragm member 34 and $S_2$ is the effective sectional area of the second diaphragm member 36.

From the above equation, it will be seen that the pressure Pe, viz., the amplified venturi vacuum in the control chamber 38 varies in proportion to only the venturi vacuum (Pv).

According to the present invention, the pressure (Pe), viz., the amplified vacuum in the control chamber 38 is varied in accordance with the following equation:

$$Pe.S_2 + Pb.S_3 = Pv.S_1$$

$$Pe = \frac{S_1}{S_2} \cdot Pv - \frac{S_3}{S_2} \cdot Pb \qquad (2)$$

where Pe is the pressure, viz., the amplified vacuum in the control chamber 38, Pv is the suction prevailing at the venturi portion 26 of the engine carburetor 28, Pb is the intake manifold vacuum at the vacuum chamber 58 of the vacuum level control unit 30, $S_1$ is the effective sectional area of the first diaphragm member 34, $S_2$ is the effective sectional area of the second diaphragm member 36, and $S_3$ is the effective sectional area of the third diaphragm member 52.

From this, it will be understood that the pressure Pe in the control chamber 38 is varied in dependence on the vacuum Pv at the venturi portion 26 and the intake manifold vacuum (Pb). Thus, the controlled pressure or the amplified venturi vacuum for actuating the valve head 20*a* of the control valve 14 increases as the venturi vacuum or suction increases and, where the venturi suction is at a constant level, the controlled pressure in the chamber 38 decreases as the intake manifold vacuum increases whereas the controlled pressure increases as the intake manifold vacuum decreases. It should thus be noted that in the case where the intake manifold vacuum is at a constant level, the controlled pressure is varied with respect to the variation in the venturi vacuum and, thus, the amount of the exhaust gas recirculation is controlled in proportion to the venturi suction or vacuum.

Figure 3:
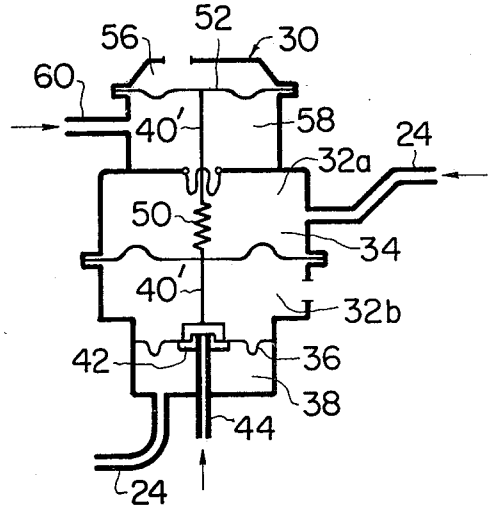
FIG. 3 is a schematic view of a modified form of the exhaust gas recirculation system shown in FIG. 2.

A modified form of the exhaust gas recirculation system according to the present invention is illustrated in FIG. 3, in which like or corresponding component parts are designated by the same reference numerals as those used in FIG. 2. This modification differs from the system shown in FIG. 2 in that biasing means such as a tension spring 50 is mounted between connecting rods 40' interconnecting the first and second diaphragm members 34 and 52. In this modification, the pressure Pe in the control chamber 38 is varied in accordance with the following equation:

$$Pe.S_2 = Pv.S_1 + F - Pb.S_3$$

$$Pe = \frac{S_1}{S_2} \cdot Pv + \frac{F}{S_2} - \frac{S_3}{S_2} \cdot Pb$$

where F is the preload of the tension spring 50.

It will now be understood from the foregoing description that the exhaust gas recirculation system of the present invention is arranged to be responsive to both venturi vacuum and intake manifold vacuum whereby, when the intake manifold vacuum is at a constant level, the amount of exhaust gas recirculation is controlled with respect to the variations in the venturi vacuum or proportionally to the amount of suction air supplied into the engine. It will also be noted that, when the intake manifold vacuum is at a high level, the amount of the exhaust gas recirculation is decreased to a level below that proportional to the amount of the air supplied into the engine whereas, when the intake manifold vacuum is at a low level, the amount of exhaust gas recirculation is increased to a level above that proportional to the amount of the suction air supplied into the engine. Thus, the amount of noxious nitrogen oxides contained in the engine exhaust gases are decreased to a low enough level for reducing air pollution throughout the various operating conditions of the engine.

What is claimed is:

1. In combination an exhaust gas recirculation system, an internal combustion engine having an intake manifold and an exhaust manifold comprising, an exhaust gas recirculation passageway interconnecting the intake and exhaust manifolds, a control valve disposed in said exhaust gas recirculation passageway and having a valve head to vary the effective cross sectional area of said exhaust gas recirculation passageway, and a vacuum level control unit to supply vacuum into said control valve for actuating said valve head in dependence thereon, said vacuum level control unit including a first chamber communicating with a venturi portion of a carburetor of the engine, a second chamber vented to the atmosphere, a third chamber communicating with said control valve, a fourth chamber communicating with the intake manifold of the engine, conduit means connected to the intake manifold of the engine and having a projecting end portion extending into said third chamber to selectively supply intake manifold vacuum thereinto, a first diaphragm member located between said first and second chambers and responsive to venturi vacuum supplied from said venturi portion of the carburetor, a second diaphragm member located between said second and third chambers and having an engaging portion selectively engageable with said projecting end portion of said conduit means to selectively close said projecting end portion of said conduit means and a plurality of bores formed therein which selectively provides fluid communication between said second and third chambers, a third diaphragm member responsive to the intake manifold vacuum supplied into said fourth chamber, and a valve element connected to said first and third diaphragm members by a connecting rod and cooperating with said second diaphragm member to open and close said bores of said second diaphragm member while selectively causing said engaging portion of said second diaphragm member to disengage from said projecting end portion of said conduit means when said bores are closed by said valve element.

2. An exhaust gas recirculation system as claimed in claim 1, further comprising a solenoid valve means disposed between the third chamber of said vacuum level control unit and said control valve unit for selectively interrupting fluid communication therebetween during starting operation of the engine.

3. An exhaust gas recirculation system as claimed in claim 1, in which said vacuum level control unit further includes a biasing means cooperating with said connecting rod.

* * * * *